US006698032B1

(12) United States Patent
Robertson

(10) Patent No.: US 6,698,032 B1
(45) Date of Patent: Mar. 2, 2004

(54) CLEANING ASSEMBLY FOR MOTORCYCLE HELMET FACE SHIELD

(76) Inventor: Ulysses Paul Robertson, 516 Monroe St., Gretna, LA (US) 70053

( * ) Notice: Subject to any disclaimer, the term of this patent is extended or adjusted under 35 U.S.C. 154(b) by 0 days.

(21) Appl. No.: 10/298,302

(22) Filed: Nov. 18, 2002

(51) Int. Cl.[7] ..... A42B 1/08

(52) U.S. Cl. ..... 2/424; 2/10; 2/422; 2/438; 15/250.001; 15/250.18; 15/250.29

(58) Field of Search ..... 2/424, 422, 10, 2/438, 426; 15/250.18, 250.3, 250.29, 250.37, 250.43, 250.001

(56) References Cited

U.S. PATENT DOCUMENTS

| | | | | | |
|---|---|---|---|---|---|
| 3,890,647 | A | * | 6/1975 | Warncke | 2/435 |
| 4,027,354 | A | * | 6/1977 | Burpee | 15/250.3 |
| 4,077,007 | A | * | 2/1978 | McKinney | 455/142 |
| 4,109,105 | A | | 8/1978 | Von Statten, Jr. | |
| 4,130,803 | A | * | 12/1978 | Thompson | 455/344 |
| 4,150,681 | A | | 4/1979 | Howarth, Jr. | |
| D262,455 | S | | 12/1981 | Bulmash et al. | |
| 4,559,516 | A | | 12/1985 | Schott et al. | |
| 4,607,395 | A | * | 8/1986 | Sundahl | 455/351 |
| 4,727,599 | A | | 2/1988 | Rappaport et al. | |
| 4,937,880 | A | | 7/1990 | Beard | |
| 5,353,008 | A | | 10/1994 | Eikenberry et al. | |
| 5,416,675 | A | | 5/1995 | DeBeaux | |
| 5,940,880 | A | | 8/1999 | Phillips | |
| 6,009,563 | A | * | 1/2000 | Swanson et al. | 2/425 |
| 6,101,256 | A | * | 8/2000 | Steelman | 381/91 |
| 6,157,298 | A | * | 12/2000 | Garfinkel et al. | 340/479 |

FOREIGN PATENT DOCUMENTS

| | | | | | |
|---|---|---|---|---|---|
| DE | 2918635 | A1 | * | 11/1980 | |
| DE | 3138767 | A1 | * | 6/1982 | A42B/3/02 |
| DE | 19740861 | | * | 5/1998 | A42B/3/22 |
| DE | 19704781 | A1 | * | 10/1998 | A42B/3/22 |
| GB | 12877746 | | * | 9/1972 | 2/438 |
| GB | 2171292 | A | * | 8/1986 | A42B/3/02 |
| JP | 01278864 | A | * | 11/1989 | B60S/1/66 |
| JP | 082194121 | A | * | 11/1996 | A42B/3/26 |

* cited by examiner

*Primary Examiner*—Rodney M. Lindsey
(74) *Attorney, Agent, or Firm*—Donald R. Schoonover

(57) ABSTRACT

A motorcycle helmet face shield is cleaned by a unit that is mounted on a visor that can be releasably attached to the helmet. The unit includes rollers that are slidably mounted on the visor in a groove defined in the visor.

2 Claims, 1 Drawing Sheet

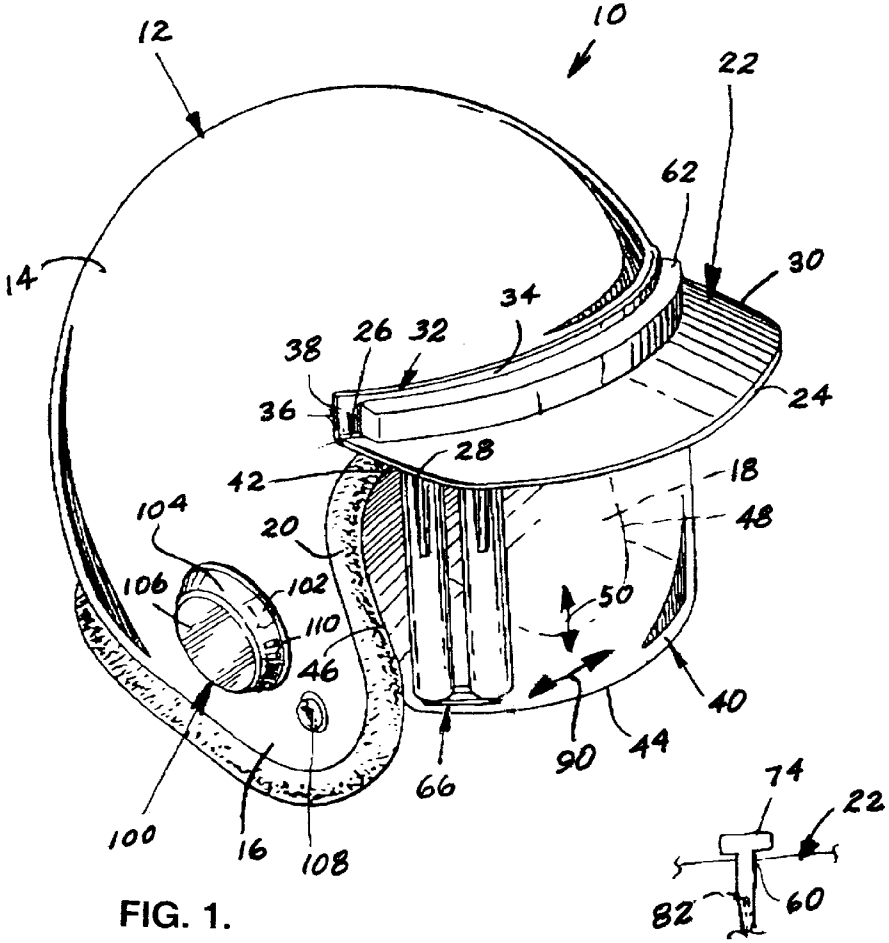
FIG. 1.
FIG. 3.
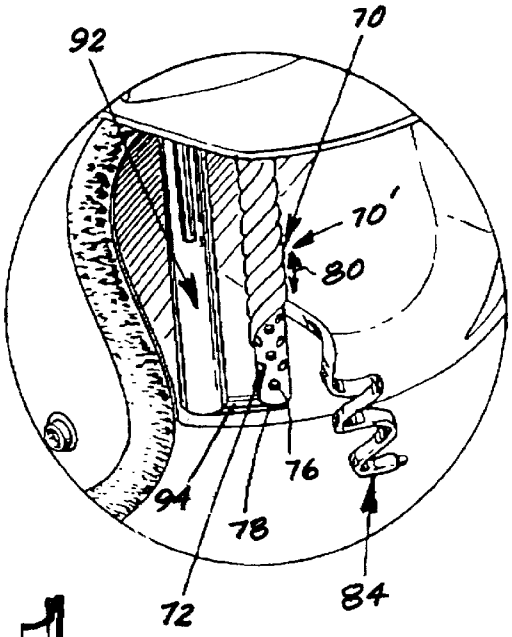
FIG. 2.
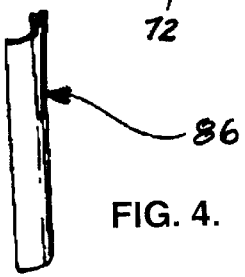
FIG. 4.

CLEANING ASSEMBLY FOR MOTORCYCLE HELMET FACE SHIELD

BACKGROUND OF THE INVENTION

1. Field of the Invention

The present invention relates to the general art of wearing apparel, and to the particular field of safety helmets.

2. Discussion of the Related Art

Many people enjoy riding a motorcycle. Motorcycles are used as a mode of transportation in urban areas and as a mode of recreation in other areas. Often motorcycles are ridden over rough and dirty terrain and in inclement weather conditions.

One problem with riding a motorcycle in inclement weather is the dirt and debris that strikes the rider during such riding. Heavy clothing can protect most of the rider's body but his or her face is generally unprotected. While a windshield on some motorcycles offers some protection, this protection is often inadequate.

All motorcyclists should wear a helmet, and this is often required by law. Many of these helmets have face shields. While offering some protection to the rider's face, these face shields often become dirty. If the face shield becomes too dirty for a clear view, the rider must clean the shield. This may require the rider to stop. Many riders do not wish to stop to clean a face shield. Therefore, such riders either continue riding with a face shield that is dirty or actually omit wearing a face shield. Not wearing a face shield removes the protection associated with a face shield.

Therefore, there is a need for a motorcycle helmet that has a face shield that can be efficiently cleaned.

Much motorcycle riding is done in clear conditions where a face shield will not become dirty. Under such conditions, it will not be necessary to clean the face shield and any equipment used to clean motorcycle face shields will be superfluous. Any extra equipment is often undesirable to a motorcyclist.

Therefore, there is a need for a motorcycle helmet that has equipment for efficiently cleaning a face shield and which can be omitted when it is not required.

PRINCIPAL OBJECTS OF THE INVENTION

It is a main object of the present invention to provide a motorcycle helmet that has a face shield that can be efficiently cleaned.

It is another object of the present invention to provide a motorcycle helmet that has equipment for efficiently cleaning a face shield and that can be removed when it is not necessary to clean the face shield.

SUMMARY OF THE INVENTION

These, and other, objects are achieved by a motorcycle helmet which comprises a head covering portion which includes an ear covering portion; a visor element releasably mounted on the head covering portion and having a groove defined therein; a face shield mounted on the head covering portion; a face shield cleaning unit movably mounted on the visor and including a first cylindrical roller element having a proximal end slidably mounted on the visor adjacent to the groove, a distal end, a bore extending between the proximal end of the first cylindrical roller element and the distal end of the first cylindrical roller element, a plurality of holes defined through the first cylindrical roller element in a radial direction on the first cylindrical roller element, the holes of the plurality of holes of the first cylindrical roller element being in fluid connection with the bore of the first cylindrical roller element, a band of liquid adsorbent material wrapped around the cylindrical body of the first cylindrical roller element and covering the holes of the plurality of holes of the first cylindrical roller element and forming a wrapped first roller element, and a cover encasing the wrapped first roller element and being in sliding contact with the face shield, a second cylindrical roller element having a proximal end slidably mounted on the visor adjacent to the groove, a distal end, a bore extending between the proximal end of the second cylindrical roller element and the distal end of the second cylindrical roller element, a plurality of holes defined through the second cylindrical roller element in a radial direction on the second cylindrical roller element, the holes of the plurality of holes of the second cylindrical roller element being in fluid connection with the bore of the second cylindrical roller element, a band of liquid adsorbent material wrapped around the cylindrical body of the second cylindrical roller element and covering the holes of the plurality of holes of the second cylindrical roller element and forming a wrapped second roller element, and a cover encasing the wrapped second roller element and being in sliding contact with the face shield, and a connecting bar connecting the distal end of the first cylindrical roller element to the distal end of the second cylindrical roller element; and a radio unit on the ear portion of the head covering portion and including a volume control on the ear portion of the head covering portion.

The helmet thus has a face shield cleaning unit that can be attached to the helmet when a motorcycle rider anticipates an climate weather condition that may cause the face shield to become dirty. At other times, the visor can be removed and the equipment associated with face shield cleaning can be omitted and the helmet worn without the face shield cleaning equipment. Thus, the helmet can be worn in inclement weather or clear weather and the face shield will be clean in either situation with no superfluous equipment being required. The visor can also provide protection associated with visors.

BRIEF DESCRIPTION OF THE DRAWING FIGURES

FIG. 1 is a perspective view of a motorcycle helmet having a face shield that can be efficiently cleaned when desired, according to the present invention.

FIG. 2 is a perspective view of detail A in FIG. 1 showing the face shield cleaning unit according to the invention.

FIG. 3 shows a connection between a roller of the face shield cleaning unit and the visor adjacent to a groove defined in the visor.

FIG. 4 shows a cover for a roller of the face shield cleaning unit, according to the present invention.

DETAILED DESCRIPTION OF THE PREFERRED EMBODIMENT

Other objects, features and advantages of the invention will become apparent from a consideration of the following detailed description and the accompanying drawings.

Referring to the figures, it can be understood that the invention is embodied in a motorcycle helmet 10 which comprises a head covering portion 12 formed of the material usually found in motorcycle helmets. Head covering portion 12 has an outside surface 14, a first ear covering portion 16 and a second ear covering portion 18. A front edge 20 is located on the first and second ear covering portions 16, 18 and on the head covering portion 12 and is positioned adjacent to a wearer's face when the helmet 10 is worn.

A visor 22 has a first side edge 24, a second side edge 26, a first end edge 28 and a second end edge 30. A lock element 32 is located on the first side edge 24 of the visor 22. The lock element 32 shown in FIG. 1 includes a base element 34 having hook-and-loop fastener material 36 on one surface thereof, and a band 38 of hook-and-loop fastener material is fixed to the outside surface 14 of the head covering portion 12. Lock element 32 thus permits the visor 22 to be fixed to the helmet 10 when desired and removed when desired. The releasable lock element 32 on the outside surface 14 of the head covering portion 12 is positioned adjacent to the front edge 20 of the head covering portion 12 and extends from adjacent to the first ear covering portion 16 to adjacent to the second ear covering portion 18. The releasable lock element 32 releasably locks the visor 22 to the head covering portion 12.

A transparent face shield 40 is mounted on the visor 22 and has a first side edge 42, a second side edge 44, a first end edge 46 and a second end edge 48. A length dimension 50 extends between the first side edge 42 of the face shield 40 and the second side edge 44 of the face shield 40. The first side edge 42 of the face shield 40 is fixed to the head covering portion 12 and extends adjacent to a wearer's face when the head covering portion 12 is worn.

A groove 60 is defined in the visor 22 adjacent to the second side edge 44 of the visor 22 and is located adjacent to the face shield 40. A compartment 62 covers the groove 60 and provides an interior volume for a purpose that will be understood from the following disclosure.

A face shield cleaning unit 66 is mounted on the visor 22 adjacent to the face shield 40. The cleaning unit 66 is in place when the visor 22 is worn. Thus, if a user wishes to include a face shield cleaning unit 66, he or she merely attaches the visor 22 to the head covering portion 12. If the user does not wish to have the face shield covering unit 66, he or she merely removes the visor 22 from the head covering portion 12. The face shield cleaning unit 66 includes a first roller element 70 which includes a cylindrical body 72, and a T-shaped proximal end 74 on the cylindrical body 72 of the first roller element 70. The T-shaped proximal end 74 of the cylindrical body 72 of the first roller element 70 is shown in FIG. 3 as being slidably accommodated in the groove 60 defined in the visor 22 and slidably engages the visor 22 adjacent to the groove 60. The compartment 62 encases the T-shaped proximal end 74 of the first roller element 70. The cylindrical body 72 of the first roller element 70 is located closely adjacent to the face shield 40 and has a plurality of holes, such as hole 76 defined therein to extend radially of the cylindrical body 72 of the first roller element 70. A distal end 78 of the cylindrical body 72 of the first roller element 70 is located adjacent to the second side edge 44 of the face shield 40. A length dimension 80 extends between the proximal end of the cylindrical body 72 of the first roller element 70 and the distal end 78 of the cylindrical body 72 of the first roller element 70. The length dimension 80 of the first cylindrical roller element 70 is essentially equal to the length dimension 50 of the face shield 40 so the roller 70 will cover the entire length of the face shield 40 to completely wipe the face shield 40 clean when desired. A bore 82 extends in the direction of the length dimension 80 of the cylindrical body 72 of the first roller element 70 and the holes 76 of the plurality of holes are in fluid communication with the bore 82 of the first roller element 70. Thus, any fluid entering the holes 76 will flow into the bore 82. A band 84 of liquid adsorbent material is spirally wrapped around the cylindrical body 72 of the first roller element 70 and covers the holes 76 of the plurality of holes in the cylindrical body 72 of the first roller element 70. A first wrapped roller element 70' is thus formed. A liquid adsorbent cover 86 encases the first wrapped roller element 70' and contacts the face shield 40 to wipe the shield 40 when the roller element 70 is moved across the face shield 40 in direction 90.

A second roller element 92 is identical to the first roller element 70 and is located adjacent to the first roller element 70. The second roller element 92 will be discussed, but no reference numbers will be attached in the interest of clarity of the Figures. The second roller element 92 includes a cylindrical body, a T-shaped proximal end on the cylindrical body of the second roller element 92, the T-shaped proximal end of the cylindrical body of the second roller element 92 being slidably accommodated in the groove 60 defined in the visor 22 and slidably engages the visor 22 adjacent to the groove 60. The cylindrical body of the second roller element 92 is located closely adjacent to the face shield 40 and has a plurality of holes defined therein to extend radially of the cylindrical body of the second roller element 92. A distal end of the cylindrical body of the second roller element 92 is located adjacent to the second side edge 44 of the face shield 40, and a length dimension extends between the proximal end of the cylindrical body of the second roller element 92 and the distal end of the cylindrical body of the second roller element 92. The length dimension of the second cylindrical roller element 92 is essentially equal to the length dimension 50 of the face shield 40. A bore extends in the direction of the length dimension of the cylindrical body of the second roller element. The holes of the plurality of holes are in fluid communication with the bore of the second roller element. A band of liquid adsorbent material is spirally wrapped around the cylindrical body of the second roller element 92 and covers the holes of the plurality of holes in the cylindrical body of the second roller element 92 and forms a second wrapped roller element. A liquid adsorbent cover encases the second wrapped roller element and contacts the face shield 40.

A bar element 94 connects the distal end 78 of the first roller element 70 to the distal end of the second roller element so the roller elements move as a unit to clean the face shield 40. The user merely grasps the bar 94 and moves the unit in direction 90 across the face shield 40 to clean the face shield 40.

A radio receiver unit 100 is mounted in the first ear covering portion 16 of the head covering portion 12 and includes an ear phone 102 mounted on the head covering portion 12, a receiver unit 104 which can receive either or both AM or FM signals, a casing 106, a volume control 108 which can also serve as an on/off control, and a station control 110. The radio unit will not be further described since any suitable unit can be used and those skilled in the art will understand how to mount such a unit on the helmet.

It is understood that while certain forms of the present invention have been illustrated and described herein, it is not to be limited to the specific forms or arrangements of parts described and shown.

What is claimed and desired to be covered by Letters Patent is:

1. A motorcycle helmet comprising:

a) a head covering portion having (1) an outside surface, (2) a first ear covering portion,
(3) a second ear covering portion, and
(4) a front edge on the first and second ear covering portions and on said head covering portion and positioned adjacent to a wearer's face when the helmet is worn;

b) a visor having
(1) a first side edge,
(2) a second side edge,
(3) a first end edge,
(4) a second end edge, and
(5) a lock element on the first side edge of said, visor;

c) a releasable lock element on the outside surface of said head covering portion adjacent to the front edge of said head covering portion and extending from adjacent to the first ear covering portion to adjacent to the second ear covering portion, said releasable lock element releasably mating with the lock element on said visor to releasably lock said visor to said head covering portion;

d) a translucent face shield having
(1) a first side edge,
(2) a second side edge,
(3) a first end edge,
(4) a second end edge,
(5) a length dimension extending between the first side edge of said face shield and the second side edge of said face shield, and
(6) the first side edge of said face shield being fixed to said head covering portion and extending adjacent to a wearer's face when said head covering portion is worn;

e) a groove defined in said visor adjacent to the second side edge of said visor and being located adjacent to said face shield;

f) a face shield cleaning unit mounted on said visor adjacent to said face shield and including
(1) a first roller element having
(A) a cylindrical body,
(B) a T-shaped proximal end on the cylindrical body of the first roller element, the T-shaped proximal end of the cylindrical body of the first roller element being slidably accommodated in the groove defined in said visor and slidably engaging said visor adjacent to said groove, the cylindrical body of the first roller element being located closely adjacent to said face shield and having a plurality of holes defined therein to extend radially of the cylindrical body of the first roller element,
(C) a distal end of the cylindrical body of the first roller element located adjacent to the second side edge of said face shield,
(D) a length dimension extending between the proximal end of the cylindrical body of the first roller element and the distal end of the cylindrical body of the first roller element, the length dimension of the first cylindrical roller element being essentially equal to the length dimension of said face shield,
(E) a bore extending in the direction of the length dimension of the cylindrical body of the first roller element, the holes of the plurality of holes being in fluid contact with the bore of the first roller element,
(F) a band of liquid adsorbent material spirally wrapped around the cylindrical body of the first roller element and covering the holes of the plurality of holes in the cylindrical body of the first roller element and forming a first wrapped roller element, and
(G) a liquid adsorbent cover encasing the first wrapped roller element and contacting said face shield,
(2) a second roller element having
(A) a cylindrical body,
(B) a T-shaped proximal end on the cylindrical body of the second roller element, the T-shaped proximal end of the cylindrical body of the second roller element being slidably accommodated in the groove defined in said visor and slidably engaging said visor adjacent to said groove, the cylindrical body of the second roller element being located closely adjacent to said face shield and having a plurality of holes defined therein to extend radially of the cylindrical body of the second roller element,
(C) a distal end of the cylindrical body of the second roller element located adjacent to the second side edge of said face shield,
(D) a length dimension extending between the proximal end of the cylindrical body of the second roller element and the distal end of the cylindrical body of the second roller element, the length dimension of the second cylindrical roller element being essentially equal to the length dimension of said face shield,
(E) a bore extending in the direction of the length dimension of the cylindrical body of the second roller element, the holes of the plurality of holes being in fluid contact with the bore of the second roller element,
(F) a band of liquid adsorbent material spirally wrapped around the cylindrical body of the second roller element and covering the holes of the plurality of holes in the cylindrical body of the second roller element and forming a second wrapped roller element, and
(G) a liquid adsorbent cover encasing the second wrapped roller element and contacting said face shield,
(3) a bar element connecting the distal end of the first roller element to the distal end of the second roller element; and g) a radio receiver unit mounted in the first ear covering portion of said head covering portion and including
(1) an ear phone mounted on said head covering portion,
(2) a receiver unit,
(3) a casing,
(4) a volume control, and
(5) a station control.

2. A motorcycle helmet comprising:

a) a head covering portion which includes an ear covering portion;

b) a visor element releasably mounted on said head covering portion and having a groove defined therein;

c) a face shield mounted on said head covering portion;

d) a face shield cleaning unit movably mounted on said visor and including
(1) a first cylindrical roller element having a proximal end slidably mounted on said visor adjacent to the groove, a distal end, a bore extending between the proximal end of the first cylindrical roller element and the distal end of the first cylindrical roller element, a plurality of holes defined through the first cylindrical roller element in a radial direction on the first cylindrical roller element, the holes of the plurality of holes of the first cylindrical roller element being in fluid connection with the bore of the first cylindrical roller element, a band of liquid adsorbent material wrapped around the cylindrical body of the first cylindrical roller element and covering the holes of the plurality of holes of the first cylindrical roller element and forming a wrapped first roller element, and a cover encasing the wrapped first roller element and being in sliding contact with said face shield, (2) a second cylindrical roller element having a proximal end slidably mounted on said visor adjacent to the groove, a distal end, a bore extending between the proximal end of the second cylindrical roller element and the distal end of the second cylindrical roller element, a plurality of holes defined through the second cylindrical roller element in a radial direction on the second cylindrical roller element, the holes of the plurality of holes of the second cylindrical roller element being in fluid connection with the bore of the second cylindrical roller element, a band of liquid adsorbent material wrapped around the cylindrical body of the second cylindrical roller element and covering the holes of the plurality of holes of the second cylindrical roller element and forming a wrapped second roller element, and a cover encasing the wrapped second roller element and being in sliding contact with said face shield, and (3) a connecting bar connecting the distal end of the first cylindrical roller element to the distal end of the second cylindrical roller element; and e) a radio unit on the ear portion of said head covering portion and including a volume control on the ear portion of said head covering portion.

* * * * *